US012584274B2

(12) United States Patent
Roux et al.

(10) Patent No.: US 12,584,274 B2
(45) Date of Patent: Mar. 24, 2026

(54) RAIL EXPANSION DEVICE AND METHOD

(71) Applicant: Siemens Mobility SAS, Chatillon (FR)

(72) Inventors: Raphael Roux, Toulouse (FR); Francesc Ripoll Batle, Toulouse (FR); Khalil Nitaq, Toulouse (FR)

(73) Assignee: Siemens Mobility SAS, Chatillon (FR)

( * ) Notice: Subject to any disclaimer, the term of this patent is extended or adjusted under 35 U.S.C. 154(b) by 616 days.

(21) Appl. No.: 18/004,102

(22) PCT Filed: Jun. 16, 2021

(86) PCT No.: PCT/EP2021/066249
§ 371 (c)(1),
(2) Date: Jan. 3, 2023

(87) PCT Pub. No.: WO2022/002593
PCT Pub. Date: Jan. 6, 2022

(65) Prior Publication Data

US 2023/0265618 A1 Aug. 24, 2023

(30) Foreign Application Priority Data

Jul. 2, 2020 (EP) ..... 20290052

(51) Int. Cl.
*E01B 11/32* (2006.01)
*E01B 25/28* (2006.01)

(52) U.S. Cl.
CPC ..... *E01B 11/32* (2013.01); *E01B 25/28* (2013.01)

(58) Field of Classification Search
CPC ..... E01B 11/32; E01B 25/28; E01B 11/28; E01B 11/42; E01B 11/00
See application file for complete search history.

(56) References Cited

U.S. PATENT DOCUMENTS 708,908 A * 9/1902 McLin ..... E01B 11/32 238/225
875,735 A * 1/1908 Rich ..... E01B 11/32 238/225

(Continued)

FOREIGN PATENT DOCUMENTS

CN 206308562 U 7/2017
CN 107268346 A * 10/2017 ..... E01B 19/003

(Continued)

*Primary Examiner* — Cheng Lin
(74) *Attorney, Agent, or Firm* — Laurence A. Greenberg; Werner H. Stemer; Ralph E. Locher

(57) ABSTRACT

A rail expansion device compensates for an expansion of a first rail with respect to a second rail. The rail expansion device joins the first rail to the second rail. The expansion device has a front connecting rail, containing a front end and a rear end, wherein the front end is configured for connecting to the first rail. A rear connecting rail, has a front end and a rear end, wherein the rear end is configured for connecting to the second rail. A splice joint is provided and configured for slidably connecting the rear end to the front end. The splice joint defines a continuous running surface from the front connecting rail to the rear connecting rail, wherein the continuous running surface has a variable longitudinal length configured for varying in function of a width of an expansion gap separating the front connecting rail from the rear connecting rail.

15 Claims, 8 Drawing Sheets

(56) References Cited

U.S. PATENT DOCUMENTS

| | | | | | |
|---|---|---|---|---|---|
| 965,540 | A | * | 7/1910 | Roe | E01B 11/28 238/244 |
| 1,342,228 | A | | 6/1920 | Rizzuto | |
| 1,639,969 | A | * | 8/1927 | Richards | E01B 11/32 238/182 |
| 2,620,986 | A | * | 12/1952 | Lorio | E01B 11/32 238/223 |
| 3,955,761 | A | | 5/1976 | Szarka et al. | |
| 4,062,490 | A | | 12/1977 | Hixson | |
| 4,171,774 | A | * | 10/1979 | Deslauriers | E01B 11/28 238/230 |
| 4,485,967 | A | * | 12/1984 | Edwards | E01B 11/32 238/226 |
| 5,533,670 | A | * | 7/1996 | Chen | E01B 11/42 238/187 |
| 2018/0222726 | A1 | | 8/2018 | Bygrave et al. | |
| 2019/0119860 | A1 | * | 4/2019 | Beutler | E01B 11/32 |

FOREIGN PATENT DOCUMENTS

| | | | | | |
|---|---|---|---|---|---|
| CN | 208455379 | U | | 2/2019 | |
| CN | 111287024 | A | | 6/2020 | |
| KR | 19980059145 | U | | 10/1998 | |
| KR | 1020160124437 | A | | 10/2016 | |
| TW | 201109498 | A | | 3/2011 | |
| WO | WO-2020015336 | A1 | * | 1/2020 | E01B 11/28 |
| WO | 2020074257 | A1 | | 4/2020 | |

* cited by examiner

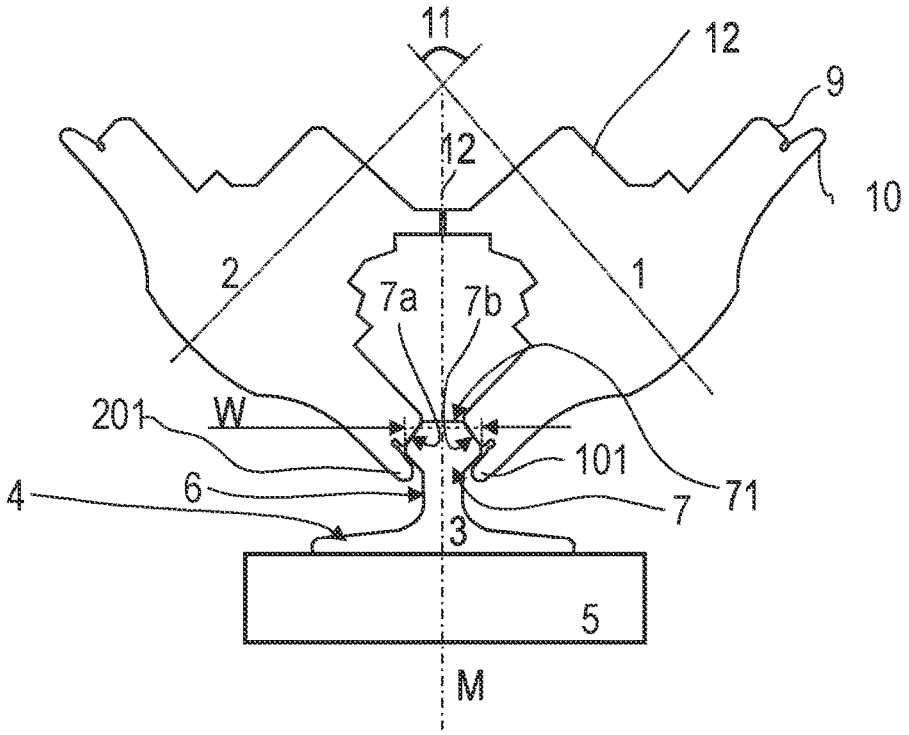
FIG 1
FIG 2
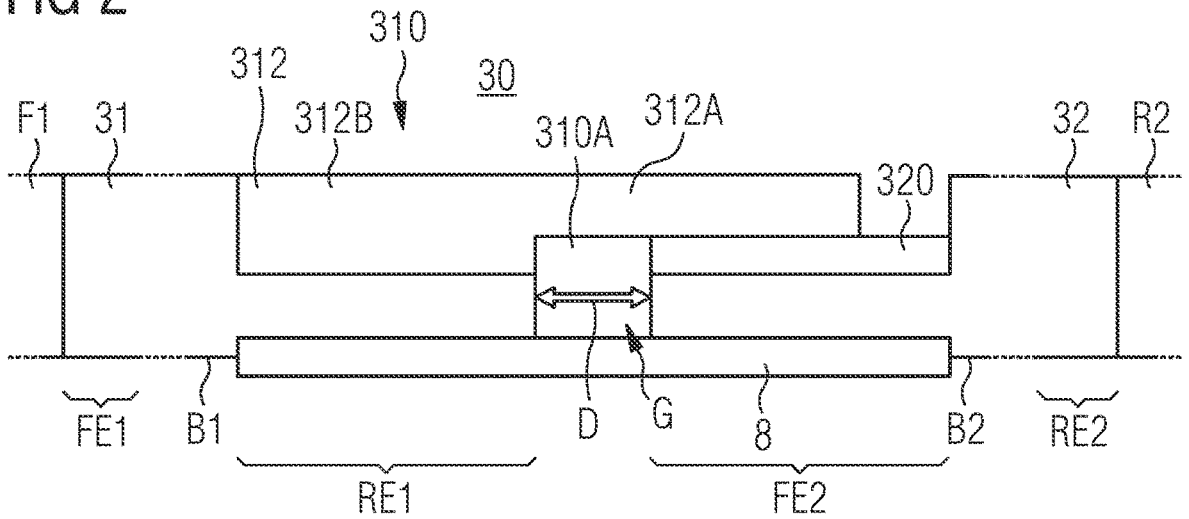

RAIL EXPANSION DEVICE AND METHOD

FIELD AND BACKGROUND OF THE INVENTION

The present invention concerns a rail expansion device and a method for compensating an expansion of a rail designed for guiding a guided vehicle.

The present invention is essentially related to the field of guided vehicles, wherein the expression "guided vehicle" refers to public transport means such as subways, trains or train subunits, buses, etc., which are configured for transporting passengers and for which safety is a very important factor. Such guided vehicles are usually guided along a route or railway by at least one rail, usually two rails. More specifically, the present invention concerns rail expansion devices, also known as expansion joints, which are installed in areas wherein a relative longitudinal movement between two axially directly adjacent rails has to be compensated. Such relative movement might result from a rail dilatation/contraction, or from the relative motion between a bridge structure wherein a rail is mounted and a ballast supporting an axially directly adjacent rail.

The present invention particularly concerns guided vehicles comprising a guidance unit guided by a single rail installed on a track. The guidance unit follows the trajectory defined by said single rail when the guided vehicle is moving on said track. The guidance unit enables for example a guided vehicle guidance system to direct a guided vehicle steering axle along said trajectory so that said guided vehicle does not leave its track, keeping the trajectory defined by the rail. Usually said steering axle is fitted with bogie wheels.

Even if the guidance unit is not part of the present invention, a short description of said guidance unit will help understanding the present invention:

The guidance unit generally includes a pair of guiding wheels, also called guiding rollers, mounted in a V and fitted with flanges making it possible to grip the rail. Such a guidance unit is for example described in documents U.S. Pat. No. 7,228,803 B2 or U.S. Pat. No. 6,029,579 A1. Vehicles guided by this type of guidance unit operate in accordance with the following general principle, described by reference to FIG. 1: said guidance unit follows the rail 3 by means of a pair of rollers 1, 2 in contact with the rail 3 and gives the guidance system a direction to be imposed on a steering axle of the guided vehicle. A rail 3 adapted for guiding such guided vehicle is usually made of a base plate 4 fixed to the ground 5 and a core 6 supporting a head 7 on which the rollers 1, 2 are supported via a tread 9. Each of the rollers 1, 2 in the same pair of guiding rollers has thus its tread 9 in contact with a surface of the head 7, called the running surface 7*a*, 7*b*, and distributed symmetrically on each side of the upper part of the head 7. When the vehicle is moving, the rollers 1, 2 are in contact with the head 7, and their respective flanges 10 encircle, without contact in nominal mode, the latter and come closer to the core 6 below it. Since the distance between the lower ends 201, 101 of the two flanges 10 encircling the head 7 is less than the width W of the head 7, an extraction of the head 7 out of the grip of said rollers 1, 2, or even out of the zone included between the treads 9 and the flanges 10, is only possible if the angle 11 at which the rollers are fixed, i.e. the angle corresponding to the sector formed by the axes of rotation of each of the rollers 1, 2 of a pair of guiding rollers and cut by the plane of symmetry of the pair of guiding rollers in a V, increases and/or if the flanges 10 and/or the outer edges of the head 7 are deformed.

The correct orientation of the vehicle is thus obtained by coupling the pair of guiding rollers of the guidance unit of the guidance system with the steering axle of the guided vehicle. If the rollers are correctly gripping the rail 3, the guided vehicle follows the trajectory described by the rail 3 when it is moving.

SUMMARY OF THE INVENTION

An objective of the present invention is to propose a rail expansion device and method capable to authorize significant rail expansion while being simple to install, easily adapted to different rail configurations, and capable of ensuring a rail-wheel contact continuity that ensures a safe displacement of the guided vehicle. In particular, the rail expansion device and method shall be adapted to guidance units as previously described.

For achieving said objective, the present invention proposes a rail expansion device and a method for compensating an expansion of a rail as disclosed by the objects of the independent claims. Other advantages of the invention are presented in the dependent claims.

The rail expansion device according to the invention is configured for connecting a first rail to a second rail, more specifically an end of the first rail, called hereafter first end, to an end of the second rail, called hereafter second end, wherein the first end is preferentially, but not obligatory, longitudinally aligned with the second end; indeed, the rail expansion device according to the invention might also join a first rail to a second rail, wherein the latter define a curve. In such a case, the rail expansion device is characterized by a curved geometry, being substantially a segment of curve configured for joining the first end to the second end.

According to the present invention, the rail expansion device is configured for connecting said first rail with said second rail, wherein the first rail and the second rail have preferentially identical transverse cross-sections, notably as illustrated in FIG. 1. Said first rail, as well as said second rail, or in other words its cross-section, is preferentially configured for guiding a guidance unit of a guided vehicle, wherein said guidance unit comprises a pair of guiding rollers 1, 2 mounted in a V (see FIG. 1), respectively a first roller 1 and a second roller 2, intended to rest respectively on a first running surface 7*a* and a second running surface 7*b* of the rail 3, said first and said second running surface 7*a*, 7*b* being positioned on each side of a median longitudinal plane M of said rail 3, each of the rollers being preferentially provided with a flange 10, the flanges 10 of the pair of guiding rollers 1, 2 making it possible to freely grip the rail 3. In the following, the running surface defined by the head geometry of the first rail or of the second rail and intended to support a wheel or roller of the guided vehicle, for instance said first running surface 7*a*, or said second running surface 7*b*, will be referred to as the nominal running surface.

The rail expansion device according to the invention comprises:

- a front connecting rail, comprising a front end FE1 and a rear end RE1, wherein the front end FE1 is configured for being connected, e.g. by welding, to the first rail, e.g. to said first end. Preferentially, the front end FE1 has a transverse cross-section identical to the transverse cross-section of the first end;
- a rear connecting rail comprising a front end FE2 and a rear end RE2, wherein the rear end RE2 is configured for being connected, e.g. by welding, to the second rail, e.g. to said second end. Preferentially, the rear end RE2 is characterized by a transverse cross-section identical to the transverse cross-section of the second end and/or first end;

optionally, a connection box configured for clamping on a first side a base of the front connecting rail and on an opposite second side a base of the rear connecting rail, said connection box being configured for preventing any transverse and/or vertical displacement(s) of the rear end RE1 with respect to the front end FE2 while authorizing a longitudinal (or axial) relative displacement of the rear end RE1 with respect to the front end FE2. Preferentially, the connection box is configured for being fixed to the ground and for clamping said bases while letting the latter longitudinally slide with respect to each other and over a predefined distance. Optionally, said connection box is not directly fixed to the ground, but is mounted mobile in translation in a clamping system, wherein said clamping system is configured for being fixed to the ground and for authorizing a longitudinal translation of the connection box with respect to the ground, while preventing any transverse and/or vertical displacement(s) of said connection box. Advantageously, the connection box together with the clamping system enable to cumulate expansions of several successive rail expansion devices according to the invention.

According to the present invention, the rail expansion device comprises a splice joint configured for slidably connecting the rear end RE1 to the front end FE2, said splice joint defining a continuous running surface from the front connecting rail to the rear connecting rail, wherein said continuous running surface is characterized by a variable longitudinal length configured for varying in function of a width of an expansion gap separating the front connecting rail from the rear connecting rail.

In particular, the splice joint comprises at least a first projecting member extending from the front connecting rail towards the rear connecting rail and configured for slidably overlapping a first variable portion of the rear connecting rail, wherein said first projecting member and said first variable portion comprise each a part of said continuous running surface, which is notably designed for supporting a roller of a guidance unit as described in FIG. 1. In other words, according to the present invention, the running surface for a roller/wheel is split between the first variable portion and the first projecting member.

Preferentially, the splice joint comprises a second projecting member extending from the front connecting rail towards the rear connecting rail and configured for slidably overlapping a second variable portion of the rear connecting rail. For instance, the first projecting member might be mounted over said second projecting member so as to define a first longitudinal opening configured for receiving a third projecting member, wherein the latter extends from the rear connecting rail towards the front connecting rail wherein it overlaps notably the second projecting member. Preferentially, a second opening is defined between the rear connecting rail and said third projecting member for receiving the second projecting member. In other words, the third projecting member is taken in sandwich between the first and second projecting members, wherein the first and second projecting members are fixed to or part of the front connecting rail and the third projecting member is fixed to or part of the rear connecting rail, so that they slidably overlap each other, wherein said first and second openings associated to the expansion gap enable the relative longitudinal displacement of the front connecting rail, and thus first rail, with respect to the rear connecting rail, by the way second rail.

According to a preferred embodiment, the first projecting member is characterized by a width that is smaller than a nominal width characterizing the first or second rail head. Preferentially, said first variable portion is characterized by a width that is equal to said nominal width of the first or second rail head. In particular, the running surface defined for a roller or wheel by the first projecting member and the running surface defined by the first variable portion for said same roller or wheel have an identical width.

According to the present invention, the front connecting rail comprises a front splice and the rear connecting rail comprises a rear splice. The front splice and the rear splice are part of said splice joint. In other words, said splice joint which enables to join the front connecting rail to the rear connecting rail by using overlapping members comprises said front splice and said rear splice. The front splice is notably configured to be fixed to the front connecting rail, notably to said rear end RE1 and the rear splice is configured to be fixed to the rear connecting rail, notably to said front end FE2. According to the present invention, the front splice comprises said first projecting member that is configured for bridging the expansion gap. The width D of the latter is notably is a function of a relative longitudinal displacement of the front connecting rail with respect to the rear connecting rail.

Preferentially, the rear splice comprises said first variable portion, and said first projecting member is configured for extending towards the rear connecting rail and for slidably resting on the first variable portion of the rear splice. The latter comprises therefore an overlapped surface, wherein the longitudinal length of said surface overlapped by the first projecting member depends on the value of the width D of the expansion gap. Accordingly, the front splice and the rear splice comprise each said running surface as defined by the first projecting member of the front splice and by said first variable portion of the rear splice, wherein said running surfaces are contiguous and/or configured for defining a continuous running surface for a roller/wheel so that said roller/wheel moving from the rear end RE1 to the front end FE2 is continuously in contact with a contact running surface which is, depending on the longitudinal position of the roller/wheel between said rear end RE1 and said front end FE2 and the width D of the expansion gap, the running surface of the first projecting member, or the running surface of the variable portion, or the running surface of the variable portion and of the projecting member.

Preferentially, the front splice comprises a top part extending according to its length longitudinally towards the rear connecting rail, said top part comprising a base part and said first projecting member, wherein the base part is configured for being fixed to the front connecting rail and wherein said first projecting member extends from the base part towards the rear connecting rail for bridging the expansion gap, the latter being notably defined between a base of the front connecting rail and a base of the rear connecting rail. The base part together with the first projecting member define a continuous running surface for the roller, wherein, for a same roller, the width of the base part running surface equals to the width of the first projecting member running surface plus the width of the variable portion running surface. In particular, the base part and the variable portion define both a rail head characterized by a width configured for being identical to the width of the first and second rail head.

Preferentially, the rear splice comprises said third projecting member, which might be configured for also bridging the expansion gap. Otherwise said, the third projecting member of the rear splice comprises said first variable portion, which defines said surface of the rear splice that is configured for being overlapped by the first projecting member, the overlapped surface length depending on the expansion gap width.

As previously explained, the third projecting member preferentially cooperates with the first and second projecting members for defining said first and second openings, which are respectively configured for enabling a longitudinal displacement of the third, resp. second, projecting member towards the front, resp. rear, connecting rail in case of a decrease of the width D of the expansion gap, and inversely in case of an increase of said width D. In particular, both or at least one of said openings might be closed when the width D of said expansion gap reaches a minimum value. The longitudinal lengths of said first and second openings vary thus in function of the value of the width D of the expansion gap. Preferentially, the first projecting member and the first variable portion comprise each, and for each roller of a guidance unit designed for guiding a guided vehicle according to a trajectory defined by said first and second rail, a part, preferentially half, of a running surface extending longitudinally and intended to support the considered roller, wherein said running surface is preferentially equal to the nominal running surface.

Preferentially, the front splice comprises a bottom part configured for being fixed to the front connecting rail and for supporting the base part of the top part, wherein said bottom part comprises or is said second projecting member. In other words, the bottom part, as for the top part, extends longitudinally towards the rear connecting rail and bridges said expansion gap. For instance, the bottom part has one side supported by the front connecting rail and another side supported by the rear connecting rail. The base part is notably configured for being fixed to the front connecting rail either directly, e.g. through holes arranged in the bottom part and/or indirectly, e.g. using fixation means configured for fixing the base part to the bottom part. A space arranged between the top part and the bottom part is configured for defining said first opening, extending longitudinally, and arranged between the first projecting member and an upper surface of the bottom part, said first opening being configured for receiving the third projecting member mounted slidably over the upper surface, overlapping therefore the bottom part over a third variable portion. The bottom part comprises notably at least a portion characterized by a constant width, said portion extending longitudinally at least from a first transverse cross-section to a second transverse cross-section, wherein said first transverse cross-section is configured for being located at a first longitudinal extremity of the first opening and the second transverse cross-section at a second longitudinal extremity of the first opening defined when the latter is at its maximum, i.e. when the width D reaches a maximal value D" for the expansion gap, wherein said first longitudinal extremity is the longitudinal extremity directed towards the front connecting rail and said second longitudinal extremity is the longitudinal extremity directed towards the rear connecting rail, wherein said constant width is configured for being equal to the width of the head of the first rail or second rail. In other words, said portion of constant width corresponds therefore to the part of the bottom part which is free of overlapping when the expansion gap is at its maximal value, and which is then configured for being overlapped by the third projecting member as the width of the expansion gap decreases from its maximal value. According to the previous description, the third projecting member rests on the bottom part and serves as support for the first projecting member, said third projecting member being sandwiched between the bottom part and the top part.

According to the present invention, the front splice comprises therefore one side supported by the front connecting rail and the longitudinally opposed other side, which comprises notably said first projecting member, configured for resting on the rear splice. As for the rear splice, it comprises one side supported by the rear connecting rail, and the opposite longitudinal side, which comprises said third projecting member, supported by the bottom part of the front splice. In particular, said third projecting part may bridge or not the expansion gap (see for instance ref. 320A in FIGS. 3 and 4). Preferentially, the front splice together and in contact with the rear splice define together a rail head configured for supporting each roller or wheel of a guidance unit that would move from the front connecting rail to the rear connecting rail.

According to the present invention and in particular, the connection box is configured for clamping the bases as explained above and for limiting their relative longitudinal displacement, providing/defining for instance a minimal value D' and the maximal value D" for the variable width D of the expansion gap. The limitation of said relative longitudinal displacement might be realized by means of a slot-pin system, wherein a slot is arranged within the connection box (and/or within one of said bases) and configured for receiving a pin fixed to the base of the first or second connecting rail (and/or resp. to the connection box), wherein the slot extends longitudinally and defines therefore a longitudinal area within which a longitudinal motion of the pin, and thus of the base (and/or resp. connection box) to which said pin is attached, is limited.

The widths of the first projecting member, base part, first variable portion, bottom part portion of constant width are notably measured in a transverse cross-section as shown in FIG. 1. Preferably, the front connecting rail comprises a rail head extending longitudinally from the front end FE1 until the front splice, and characterized by a width equal to said nominal width. In other words, the rail expansion device comprises, from said front end FE1 until said first projecting member, a rail head characterized by a width equal to said nominal width. Similarly, the rear connecting rail comprises a rail head extending longitudinally from the rear end RE2 until the rear splice, and characterized by a width equal to said nominal width. Advantageously, due to the sandwich construction of the rail expansion device, the above-mentioned features ensure that the rail expansion device has continuously, from the front end FE1 to the rear end RE2, a rail head width equal to said nominal width. Further, in order to improve the rigidity of the rail expansion device according to the invention, the first projecting member preferentially comprises a reinforcement structure, installed on its top surface and extending from the front connecting rail to the second connecting rail. In particular, since the longitudinally extending reinforcement structure is mounted on top of the first projecting member, the rail height at the location of this first projecting member is greater that the nominal rail height of the first or second rail. In order to enable a sliding contact shoe of the guidance unit to climb this additional height, the rail expansion device further comprises a first ramp connecting the top surface of the rail head of the front connecting rail to the top surface of the reinforcement structure, and a second ramp connecting said top surface of the reinforcement structure to the top surface of the rail head of the rear connecting rail.

The concept of the present invention might be applied to different rail head configurations. A preferential use of the rail expansion device according to the invention concerns rails for guiding guidance units comprising a pair of guiding rollers 1, 2, mounted in a V as described in FIG. 1. In such a case, the first rail and the second rail are typically characterized by a rail head (see FIG. 1) whose width W is greater than the distance separating the lower ends 101, 201 of the flanges 10 of the guiding rollers 1, 2 in order to prevent an extraction of the rail outside of the jaw formed by the flanges 10. As shown above, the rail expansion device according to the invention enables in particular to keep said width W continuously from the first end until the second end, preventing therefore any vertical motion of the flanges and rollers, or otherwise said, any extraction of the rail expansion device outside from said jaw, and that could result in the guidance unit leaving the trajectory defined by the first and second rails.

Finally, the present invention proposes also a method for compensating an expansion, i.e. a longitudinal displacement, of an end (i.e. the so-called first end) of a first rail relatively to an end (i.e. the so-called second end) of a second rail, the method comprising connecting the first end to the second end by means of a rail expansion device as previously described.

Further aspects of the present invention will be better understood through the following drawings, wherein like numerals are used for like and corresponding parts:

BRIEF DESCRIPTION OF THE FIGURES

FIG. 1 schematic front representation of a rail configured for guiding a guidance system with a pair of guiding rollers mounted in a V.

FIG. 2 schematic side view of the main concept of a rail expansion device according to the invention.

DETAILED DESCRIPTION OF THE INVENTION

Figure 3:
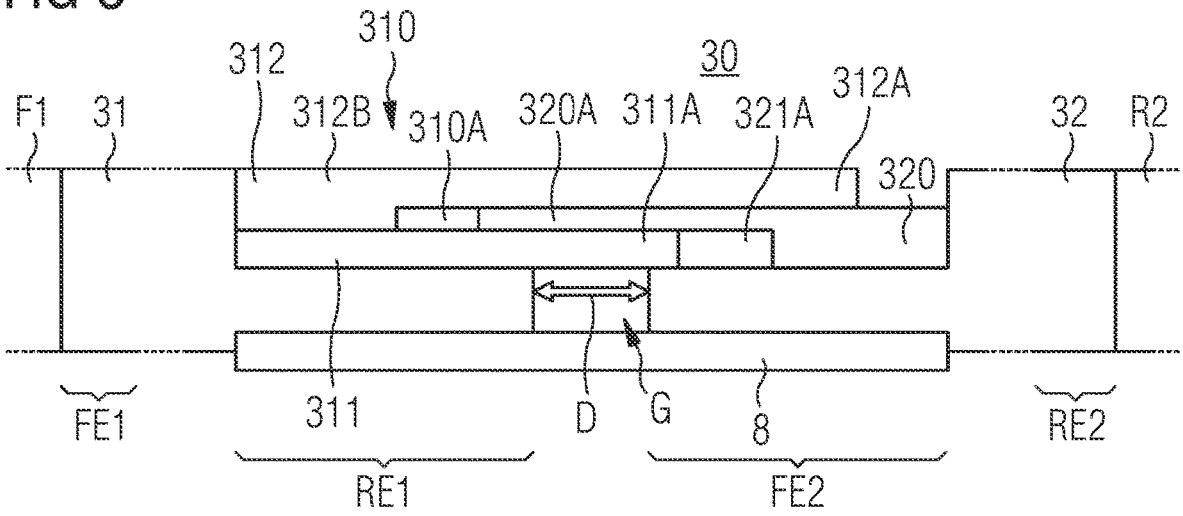
FIG. 3 schematic side view of a first preferred embodiment of the concept according to the invention.

FIG. 1 illustrates a rail 3 adapted for guiding a guidance unit comprising a pair of guiding rollers 1, 2 mounted in a V, respectively a first roller 1 and a second roller 2, intended to rest respectively on a first running surface 7*a* and a second running surface 7*b* of the rail 3, said first and said second running surface 7*a*, 7*b* being positioned on each side of a median longitudinal plane M of said rail 3, each of the rollers being preferentially provided with a flange 10, said flanges 10 making it possible to freely grip the rail 3.

Figure 5:
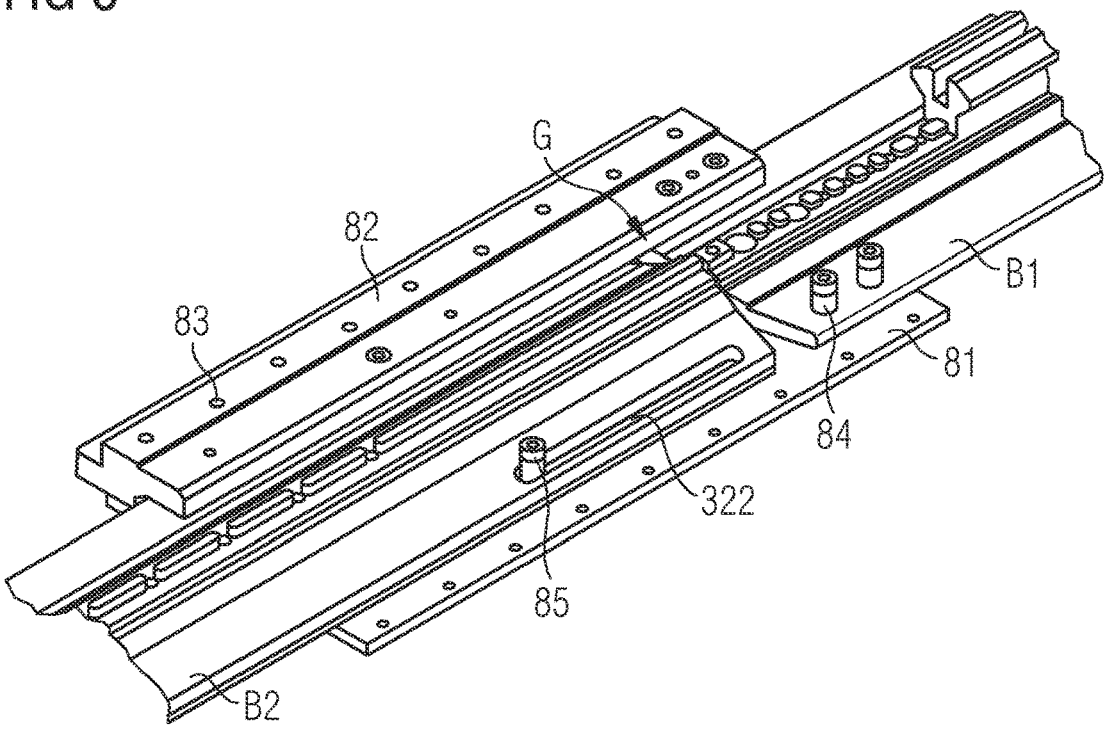
FIG. 5 schematic illustration of a preferred realization of a connection box with the expansion gap at its minimum value.
Figure 6:
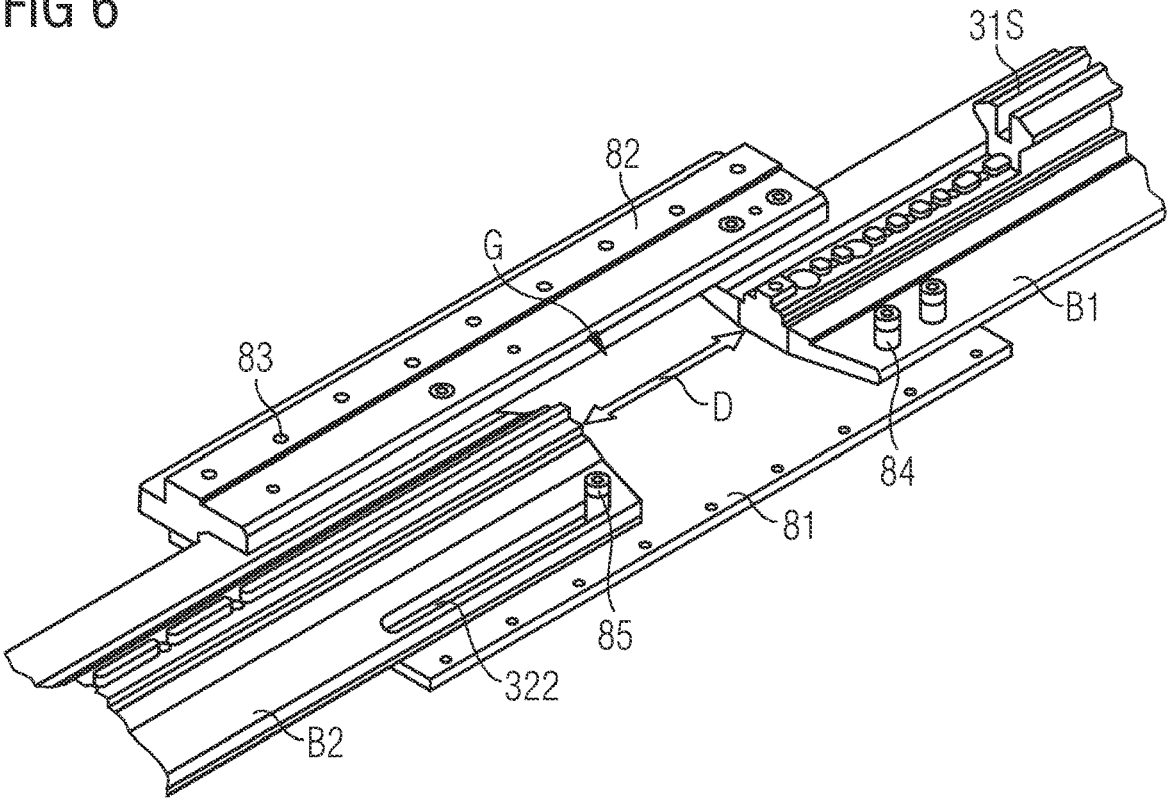
FIG. 6 schematic illustration of a preferred realization of a connection box with the expansion gap at its maximum value.
Figure 7:
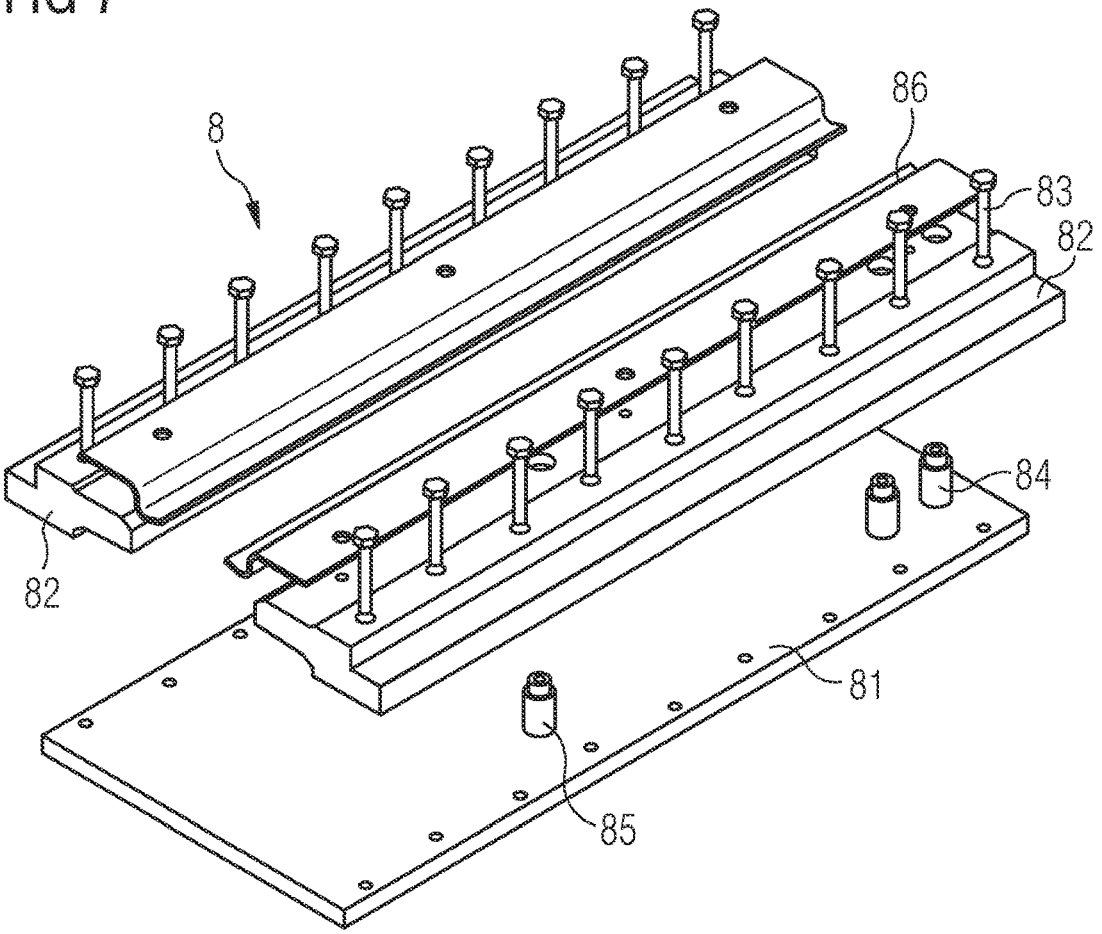
FIG. 7 details of a preferred construction of the connection box according to the invention.

The rail expansion device 30 according to the invention is schematically illustrated in FIG. 2. It comprises a front connecting rail 31 and a rear connecting rail 32, configured for joining, i.e. for being fixed to, respectively a first rail and a second rail. For instance, a front end FE1 of the front connecting rail 31 is configured for being fixed to a first end F1 of the first rail and a rear end RE2 of the second connecting rail 32 is configured for being fixed to a second end R2 of the second rail. Said front end FE1 and rear end RE2 can be fixed respectively to said first end F1 and second end R2 by any known means in the art, like welding, screw and bolt systems, clamping means, tenon and mortise systems, etc., or a combination of the latter. In particular, the front connecting rail 31 and the rear connecting rail 32 comprise each a base, respectively a base B1 for the front connecting rail 31 and a base B2 for the rear connecting rail 32 (see for instance FIGS. 5 and 6), as well as a web and a rail head and are configured for supporting and guiding a guidance unit of a guided vehicle. Said bases are adapted for resting on a supporting surface, like the ground or railroad ties. Preferentially, a transverse-cross section of the front end FE1 base B1 is in particular identical to a transverse-cross section of the rear end RE2 base B2 and they are preferentially also geometrically identical to the transverse cross-section of the base of the first end F1 or respectively second end R2. Indeed, the transverse cross-section and/or geometry of the front end FE1, respectively rear end RE2, is preferentially identical to the transverse cross-section and/or geometry of the first end F1, respectively second end R2 in order to provide continuity for the rail and to ease their connection. According to the present invention, the transverse cross-section and/or geometry of the rear end RE1 is in particular substantially different from the transverse cross-section and/or geometry of the front end FE2 so that they can cooperate together for compensating and expansion/contraction of the first rail relatively to the second rail.

According to the present invention, the rear end RE1 and the front end FE2 are slidably connected to one another by means of a splice joint of the rail expansion device 30. Said splice joint comprises at least a first projecting member 312A extending from the front connecting rail 31 towards the rear connecting rail 32 and configured for slidably overlapping a first variable portion of the rear connecting rail 32. According to the present invention, the first projecting member 312A and said first variable portion define together a continuous running surface for a roller of a guidance unit, wherein said continuous running surface is characterized by a variable longitudinal length whose variation depends on a value of a width D of an expansion gap G separating the rear end RE1 from the front end FE2. Preferentially, a front splice 310 of the splice joint comprises said first projecting member 312A and a rear splice 320 of the splice joint comprises said first variable portion. Otherwise said, the front connecting rail 31 is equipped with said front splice 310 and the rear connecting rail 32 is equipped with said rear splice 320.

Preferentially, the first connecting rail 31, resp. the second connecting rail 32, has a shape of a rail, i.e. with, as usual, base, web, and head, and extends from the front end FE1 to the rear end RE1, resp. from the rear end RE2 to the front end FE2, wherein, at said rear end RE1, resp. front end FE2, the head and optionally part of the web has been cut off/removed for receiving said front splice 310, respectively said rear splice 320, which comprises running surfaces for each roller/wheel of the guidance unit. The front splice 310 and the rear splice 320 form a splice joint configured for compensating an expansion of the length of the rail system formed by the first and second rail. The front splice 310, and optionally the rear splice 320 as illustrated in FIG. 3, are configured for longitudinally extending over the expansion gap G arranged notably between the bases B1, B2, projecting therefore beyond the base B1, respectively base B2 for the rear splice 320, and bridging said expansion gap G separating the base B1 of the front connecting rail 31 from the base B2 of the rear connecting rail 32. The front splice 310, resp. the rear splice 320, might be fixed to the body/structure of the front connecting rail 31, resp. rear connecting rail 32, by any known means like welding, clamping systems, screw and bolt systems, or a combination of the latter.

Preferentially, the base B1, resp. B2, extends longitudinally from the front end FE1, resp. FE2, to the rear end RE1, resp. RE2. According to the present invention, the base B1 is separated from the base B2 by said expansion gap G which enables a relative longitudinal displacement or translation of one of said bases with respect to the other. In other words, and for instance, in case of an extension or dilatation of the first rail, the first end F1 will for instance push the front connecting rail 31 towards the rear connecting rail 32, decreasing therefore the width D of the expansion gap G. At the opposite, a contraction of the first rail will increase the width D of the expansion gap G. Said variable width D of the expansion gap G enables therefore the rail expansion device to compensate any longitudinal relative motion of the first end F1 with respect to the second end R2. A maximal value D" for the width D of the expansion gap G is for instance comprised between 100 mm and 200 mm, being preferentially 150 mm. A minimal value D' can be zero or greater than zero, but preferentially close to zero.

Said bases B1, B2 are in particular configured for cooperating with a connection box 8, which is notably configured for limiting said maximal value D", and optionally for defining the minimal value D' for the expansion gap G, wherein D' might be equal to zero. Said connection box 8 has a substantially rectangular shape, extending longitudinally from a first side to a second side opposed to the first side, connecting the rear end RE1 to the front end FE2. The connection box 8 is preferentially adapted for clamping the rear end RE1 on the first side and the front end FE2 on the second side so that a relative longitudinal translation of the rear end RE1 with respect to the front end FE2 is authorized while any transverse and/or vertical displacement is prevented.

FIGS. 5 to 8 show more details regarding preferred embodiments of the connection box 8 according to the invention. Said connection box 8 comprises preferentially:

- a ground plate 81, characterized notably by a rectangular shape, and configured for extending from the rear end RE1 to the front end FE2, wherein its longitudinal length is configured for enabling the width D of the expansion gap G reaching said maximal width D" separating the longitudinal extremities of the bases B1 and B2;
- a pair of longitudinal clamps 82 configured for being fixed to the ground plate 81, e.g. by means of screws 83 and/or bolts, wherein one longitudinal side of the ground plate 81 is configured for receiving one of said longitudinal clamps 82 and the opposite longitudinal side is configured for receiving the other longitudinal clamp 82, so that each longitudinal side of the bases B1, B2 be clamped by one of said longitudinal clamps 82. In particular, the longitudinal length of each of said longitudinal clamps 82 is equal to the longitudinal length of the ground plate 81. Each longitudinal clamp 82 comprises preferentially a projecting part 821 directed to, i.e. extended in the direction of, the web of the rail and configured for enabling a longitudinal edge of the bases B1 and B2 to be taken into sandwich between the ground plate 81 and the projecting part 821 (see FIG. 8);
- optionally, the connection box comprises for each longitudinal clamp 82 a protection carter 86, configured for being fixed to a top surface of the longitudinal clamp 82, e.g. over its projecting part 821, and configured for having one longitudinal side contacting a rail base surface preferentially comprised between the rail web and a longitudinal edge of the projecting part 821 so that the space located between said longitudinal edge and the rail base is closed and remains thus free of dust that could impede the sliding of the bases B1, B2 within the connection box 8.

The connection box 8 further comprises pins for limiting the relative displacement of one base with respect to the other base within the connection box 8. For instance, one or several fixing pins 84 are fixed to the ground plate 81, extending preferentially perpendicularly to it, and are configured for being received within a corresponding hole arranged in the base B1 of the front connecting rail 31 (see FIG. 5-6), said hole extending and opening in an additional corresponding hole arranged in the projecting part 821, wherein the system "fixing pin 84—receiving holes" (i.e. the receiving holes including the base receiving hole and the projecting part receiving hole) is configured for preventing a relative motion of the base with respect to the connection box 8, the hole having for instance a diameter substantially equal to the diameter of the fixing pin. Additionally, at least one sliding pin 85, is configured for sliding within a slot 322 arranged in the base B2 of the rear connecting rail 32. Of course, instead of fixing the base B1 to the connection box 8, the fixing pins 84 can be configured for fixing the connection box 8 to the base B2, and in such a case, the base B1 would then comprise said slot 322. Optionally, the connection box comprises only sliding pins 85 arranged on its ground plate 81, wherein at least one of said sliding pins 85 is configured for sliding in a slot 322 of the base B1 while at least another of said sliding pins 85 is configured for sliding in a slot 322 of the base B2. In any case, said slot 322 is preferentially a longitudinal slot extending parallel to the rail web and whose length is configured for limiting the relative displacement of the base B1 with respect to the base B2, defining therefore the so-called minimal value D' and maximal value D" for the expansion gap G. The sliding pin 85 extends preferentially vertically, i.e. perpendicularly to the ground plate 81, goes through the slot 322 and is then received in a hole arranged in the projecting part 821 of the longitudinal clamp 82, as shown e.g. in FIGS. 5 and 6. The latter show in particular two configurations of the rail expansion device 30, wherein in a first configuration illustrated by FIG. 5, the expansion gap G is at its minimal value, i.e. its width D=D', and wherein in a second configuration illustrated by FIG. 6, the expansion gap G is at its maximal value, i.e. its width D=D". According to the present invention, and preferentially, the sliding pins 85 and the fixing pins 84 are arranged on the ground plate 81 so as to be symmetrically located on each side of the rail with respect to the longitudinal median plane M perpendicular to the ground plate 81. Of course, other embodiments are also possible, wherein for instance the projecting part 821 comprises one or several slots, and the base B1 and/or B2 comprises a sliding pin cooperating with one of said slots. If only one base is mobile with respect to the connection box, then the other base comprises at least one fixing pin that is fixed to the projecting part 821.

Figure 8:
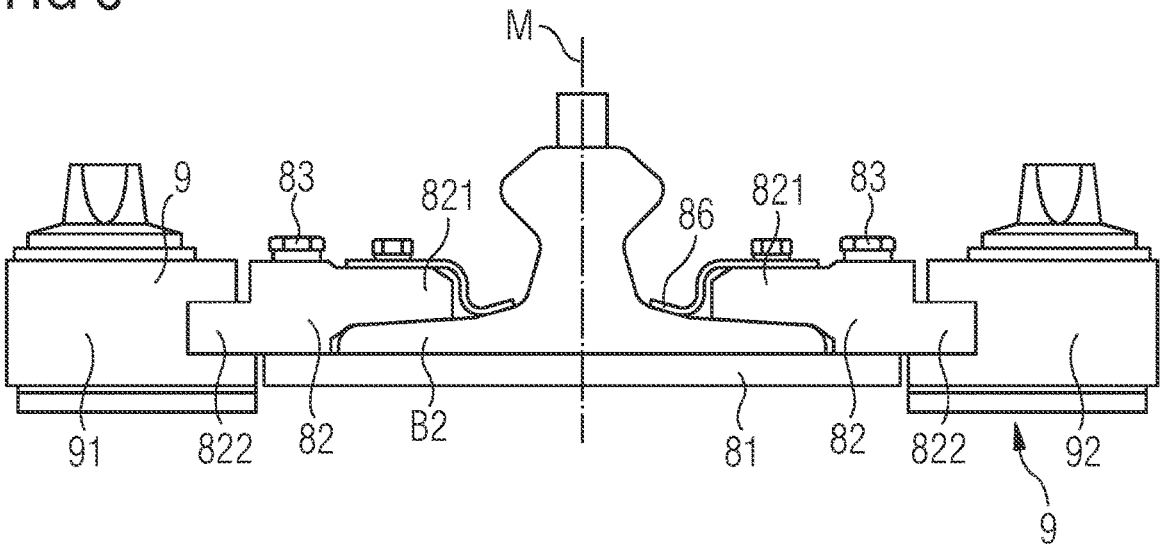
FIG. 8 details of a transverse cross-section of a preferred embodiment of the rail expansion device according to the invention.
Figure 11:
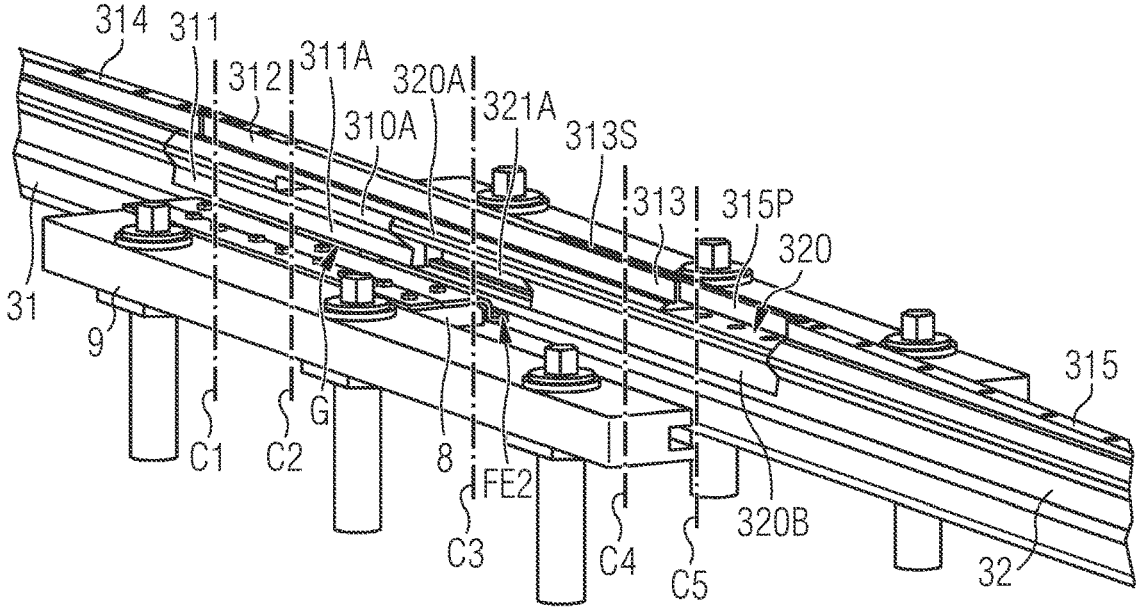
FIG. 11 three-dimensional schematic representation of a preferred embodiment of the rail expansion device according to the invention.
Figure 15:
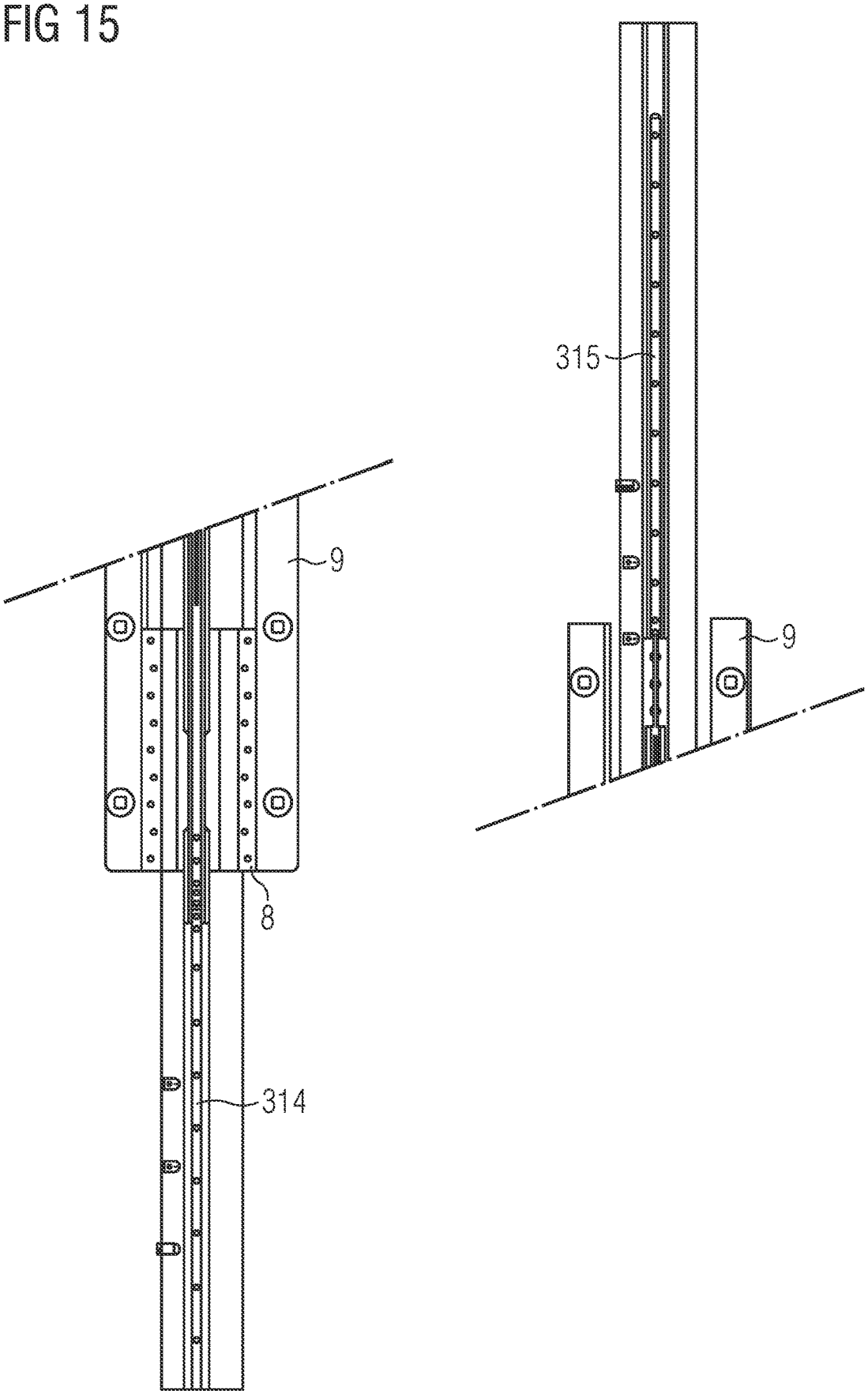
FIG. 15 top view of a rail expansion device according to the invention.

Optionally, according to a preferred embodiment, the connection box 8 might be directly fixed to the ground. According to another preferred embodiment, the connection box 8 is mounted mobile in translation in a clamping system 9 as shown in FIGS. 11 and 8, wherein said clamping system 9 is configured for being fixed to the ground. The clamping system 9 comprises notably a first longitudinal main clamp 91 and a second longitudinal main clamp 92 configured each for clamping the connection box 8 so that a longitudinal motion of the connection box 8 within the main clamps 91, 92 is possible while a transverse and/or vertical motion is prevented. For instance, the first longitudinal main clamp 91 is configured for longitudinally clamping one of the longitudinal clamps 82 and the second longitudinal main clamp 92 is configured for longitudinally clamping the other of said longitudinal clamps 82. For instance, they are each configured for clamping an external projecting part 822 of the longitudinal clamp 82 of the connection box 8, which is arranged along a part or the whole longitudinal length of the longitudinal clamp 82 and wherein said external projecting part 822 extends away from the rail or clamped base B1, B2, e.g. in a direction perpendicular to the median plane M. As shown in FIGS. 11 and 15, the longitudinal length of the clamping system 9, notably of said first and second longitudinal main clamps 91, 92 is greater than the longitudinal length of the connection box 8. For instance and preferentially, the longitudinal length of the clamping system 9 equals the longitudinal length of the connection box added to one or several times the width of the expansion gap G. Advantageously, since the connection box 8 is configured for being mobile within the clamping system 9, it enables to have several rail expansion devices 30 according to the invention mounted in series, e.g. one directly after another, so as to increase the maximal width of a total expansion gap, the latter being the sum of the maximal width of the expansion gaps of each rail expansion device comprised in said series. Advantageously, the present invention enables to connect in series at least up to three rail expansion devices according to the invention, in order to authorize for instance a maximal width equal to 45 cm for the total expansion gap, each rail expansion device of the series enabling typically a maximal width of 15 cm for its expansion gap.

Figure 4:
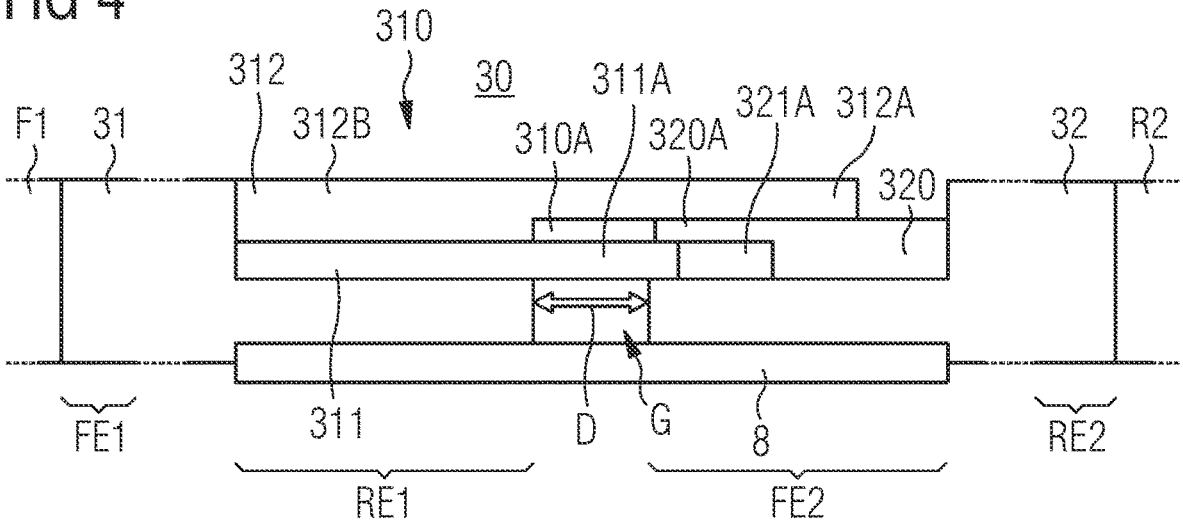
FIG. 4 schematic side view of a second preferred embodiment of the concept according to the invention.

As shown in FIGS. 2 to 4, the splice joint comprises at least one projecting member, notably said first projecting member 312A, that bridges the expansion gap G and cooperates with the rear connecting rail 32 for overlapping and sliding over a variable portion of the latter. Preferentially, and as already explained, the front end FE2 of the rear connecting rail 32 comprises a rear splice 320 that comprises said variable portion configured for being overlapped by the first projecting member 312, and the front connecting rail 31 comprises a front splice 310 that comprises said first projecting member 312A. The front splice 310 and the rear splice 320 components of the rail expansion device form said splice joint. According to FIG. 2, the splice joint comprises a single projecting member, that is said first projecting member 312A. According to FIGS. 3 and 4, the splice joint comprises several, preferentially three projecting members, namely a first projecting member 312A, a second projecting member 311A, and a third projecting member 320A. Preferentially, at least two projecting members bridge the expansion gap G. Preferentially, said at least two projecting members bridging the expansion gap G extend from the rear end RE1 of the front connecting rail 31 towards the rear connecting rail 32 and each of them then overlaps and slides over a variable portion of the rear connecting rail 31. For instance, FIGS. 3 and 4 show the first and second projecting members extending over the expansion gap G, overlapping and sliding on the first variable portion of the rear splice 320 and respectively on the second variable portion of the rear connecting rail 32. Said second variable portion is a part of the front end FE2 that is configured and adapted for slidably receiving and supporting the second projecting member 311A. The first, resp. second, projecting member is slidably mounted with respect to the third projecting member 320A, resp. body/structure of the rear connecting rail and the third projecting member 320A. The third projecting member 320 may extend over the expansion gap G as shown in FIG. 3, one side being supported by the rear connecting rail 32 and one side supported by the front connecting rail 31, i.e. extending beyond the free extremity of the front end FE2, or may extend in direction of said expansion gap, but without extending beyond said free extremity of the front end FE2, said free extremity being the extremity of the rear connecting rail that is directed towards the rear end RE1.

Figure 9:
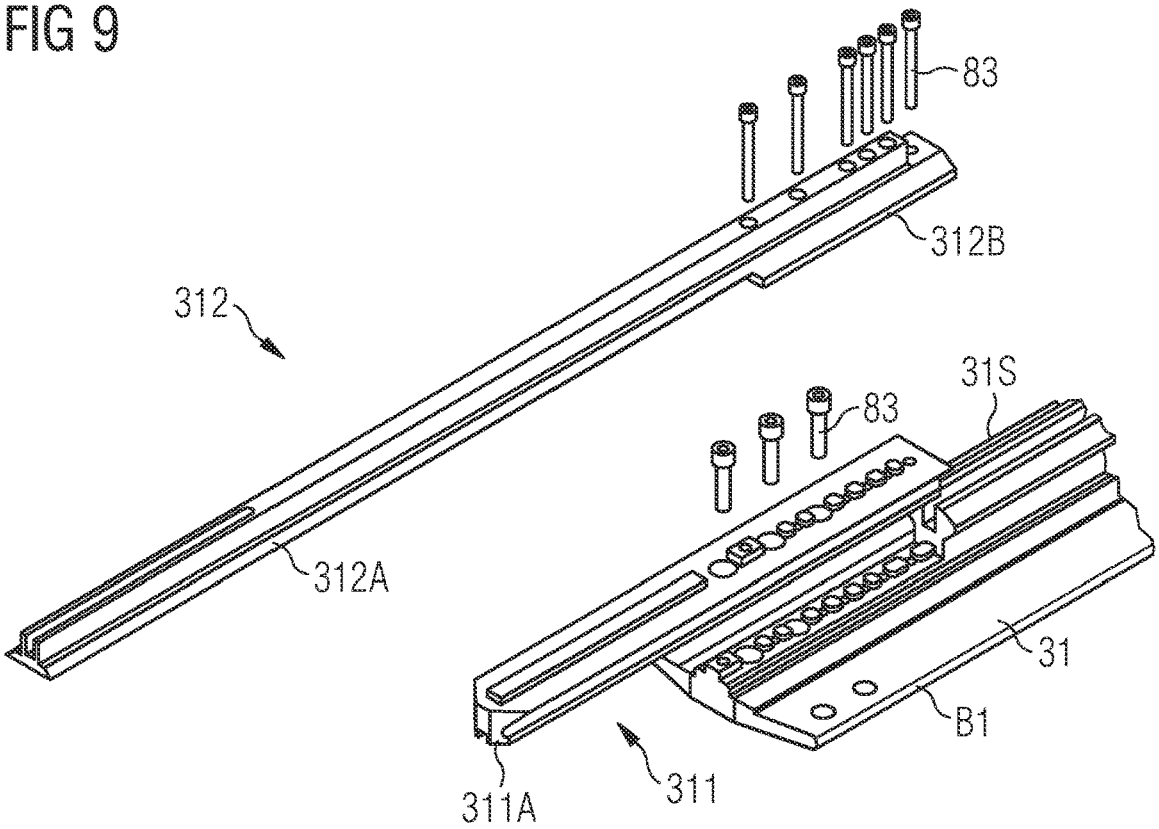
FIG. 9 three-dimensional illustration of a preferred embodiment of a front splice and front connecting rail according to the invention.
Figure 10:
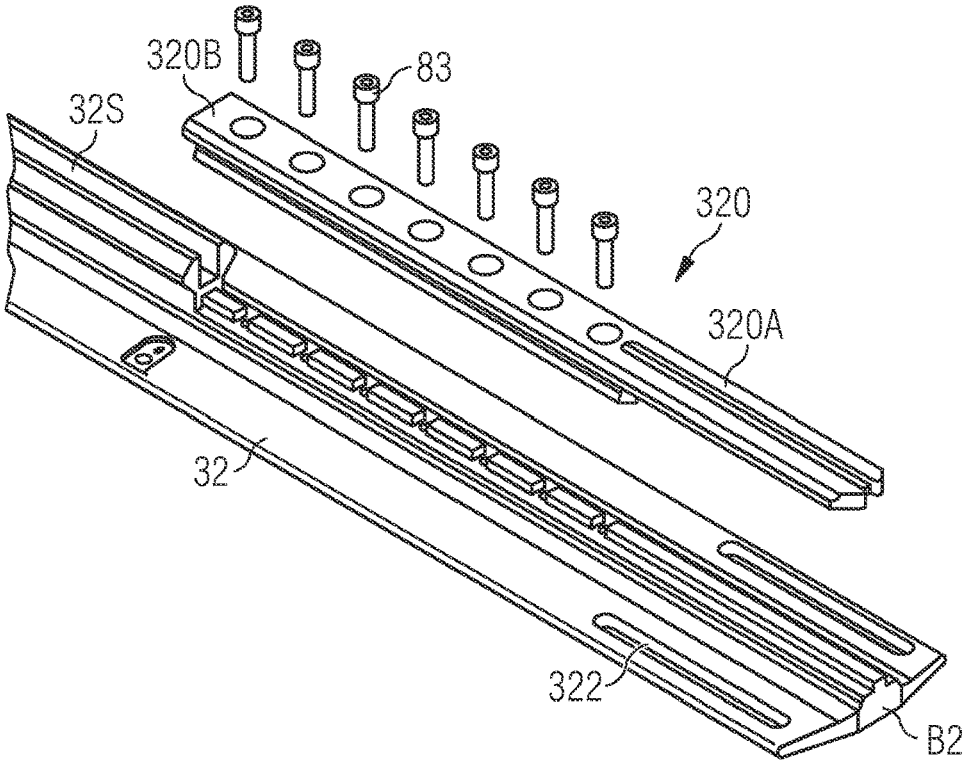
FIG. 10 three-dimensional illustration of a preferred embodiment of a rear splice and rear connecting rail according to the invention.

Preferred embodiments of the front and rear splices are illustrated by means of FIGS. 9 and 10. As shown in FIG. 9, the front splice is configured for being fixed to the rear end RE1 of the front connecting rail 31. As for the rear splice, it is configured for being fixed to the front end FE2 of the rear connecting rail 32 (see FIG. 10). Fixing means like screws 83 and/or bolts are preferentially used for fixing the splices 310, 320 to the body/structure of their respective connecting rails 31, 32. The front splice 310 is configured for extending longitudinally towards the rear connecting rail 32 and comprises at least said first projecting member 312A extending beyond the base B1, bridging the expansion gap G, and having therefore one of its extremities supported by the rear connecting rail 32. The rear splice 320 is configured for extending longitudinally, comprising preferentially said third projecting member 320A that extends longitudinally towards the front connecting rail 31, according to a first embodiment, said extension going beyond the base B2 so as to bridge also the expansion gap G, and according to a second embodiment said extension going only until the end of the base B2 and not further in direction of the front connecting rail 31 so that its longitudinal extension in direction of the front connecting rail 31 stops at the end of the front end FE2.

Preferentially, the front splice 310 comprises a top part 312 extending according to its length longitudinally towards the rear connecting rail 32 and configured for bridging said expansion gap G. The top part 312 comprises a base part 312B and said first projecting member 312A, wherein the latter extends from the base part 312B towards the rear connecting rail 32. The base part 312B is configured for resting and being fixed to the body/structure of the front connecting rail 31. Optionally, the front splice 312 comprises a bottom part 311 configured for extending, according to its length, longitudinally towards the rear connecting rail 32, having one of its longitudinal extremities fixed and supported by the body/structure of the front connecting rail 31, and its other longitudinal extremity configured for resting and being supported by the rear connecting rail 32. The bottom part 311 is therefore preferentially also configured for bridging said expansion gap G. Preferentially, the base part 312B is configured for being supported by the bottom part 311, being for instance screwed to the bottom part 311 and/or to the body/structure of the front connecting rail 31. Between the first projecting member 312A and the bottom part 311, a first opening 310A is longitudinally arranged for receiving the third projecting member 320A of the rear connecting rail rear splice 320.

The rear splice 320 comprises also a base part 320B and said third projecting member 320A, the latter being notably configured for extending from said base part 320B towards the rear end RE1, i.e. beyond the base part 320B. The latter is preferentially configured for resting and being fixed to the body/structure of the rear connecting rail 32. As already explained, the third projecting member 320A might be configured for bridging or not the expansion gap G. The third projecting member 320A is configured for sliding and resting in the first opening 310A arranged between the first projecting member 312A and the bottom part 311 of the front splice 310. In particular, said third projecting member 320A extends beyond the base part 320B so as to create a second opening 321A (see FIG. 3-4 together with FIG. 10) arranged between the third projecting member 320A and the body/structure of the rear connecting rail 32, more precisely of the front end FE2. The second opening 321A is configured for receiving the second projecting member 311A, that is the part of the bottom part 311 that is configured for extending beyond the rear end RE1 of the front connecting rail 31. In particular, the second projecting member 311A is mounted sliding within said second opening 321A and the third projecting member 320A is mounted sliding within the first opening 310A.

According to the present invention, the first projection member 312A overlaps a corresponding overlapped part of the rear splice 320 over a variable length whose variation is a function of the variable width D of the expansion gap G. Said overlapped part comprises at least the projecting part 320A: for instance, the first projecting member 312A is configured for sliding over a top surface of the third projecting member 320A and a top surface of the base part 320B which are continuous with each other.

Figure 12:
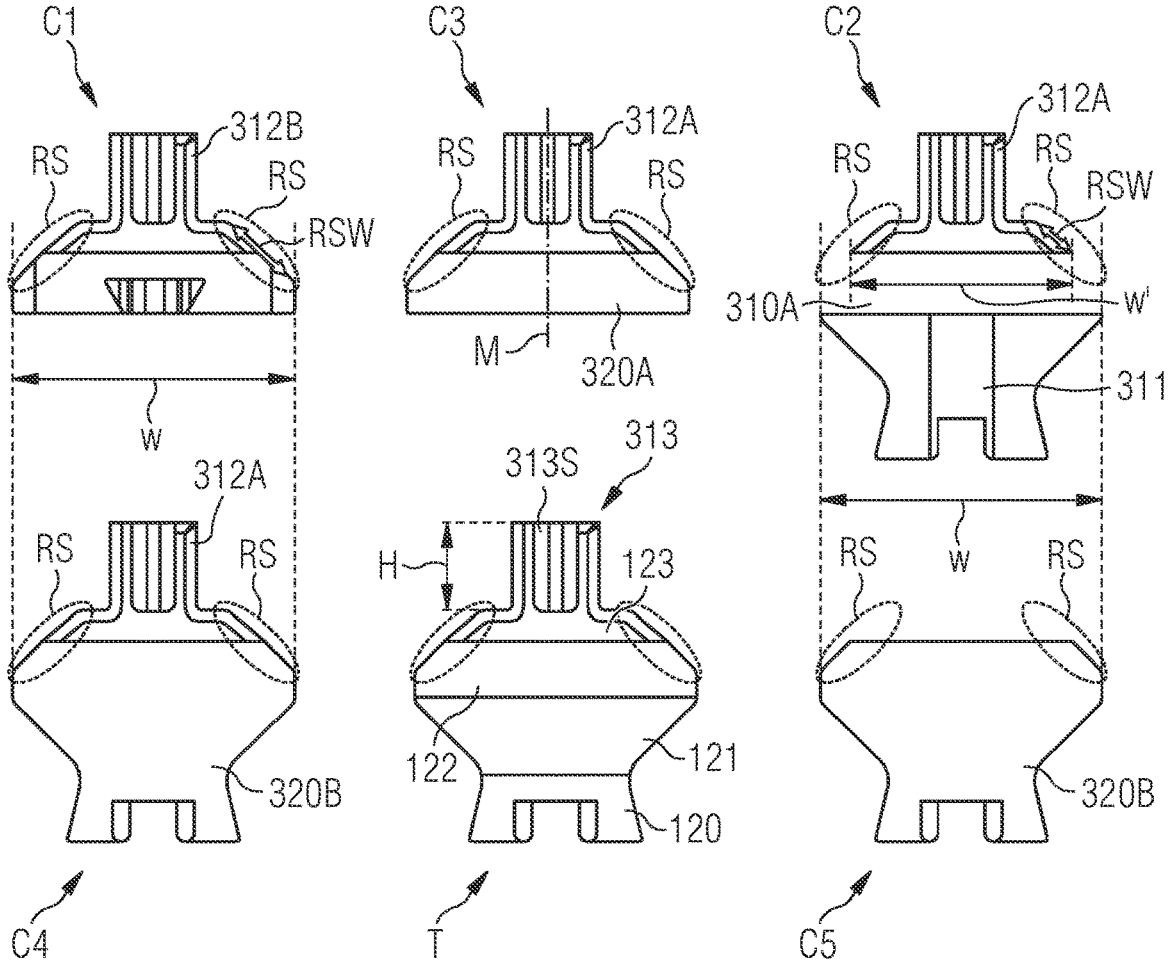
FIG. 12 schematic illustration of roller running surfaces for different transverse cross-sections C1-C5 of the preferred embodiment shown in FIG. 11.

According to the present invention, the wording "top", "bottom", "upper" refer to the vertical construction of the rail expansion device with respect to the ground, wherein a preferred vertical construction is illustrated by means of the transverse cross-section T of FIG. 12: the front splice bottom part 311 is mounted over the rear end RE1 which comprises at least the base B1 and optionally a bottom part of the web. the front splice bottom part 311 comprises at least a bottom part 121 of the rail head and optionally an upper part 120 of the web, wherein the rear splice 320 has its base part 320B mounted over the front end FE2 which comprises at least the base B2 and optionally a bottom part of the web, the rear splice base part 320B and the third projecting member 320A comprising at least a middle part 122 of the rail head, said base part 320B further comprising the bottom part 121 of the rail head and optionally also said upper part 120 of the web, the third projecting member 320A being mounted on top of the second projecting member 311A, and finally, the top part 312 of the front splice 310 is installed on top of the bottom part 311 and rear splice 320, said top part 312 comprising at least an upper part 123 of the rail head extending from its base part 312B to its first projecting member 312A, its base part 312B further comprising said middle part 122 of the rail head. The superposition of the upper, middle, and bottom parts of the rail head, or in other words, their projection on a transverse plane, defines a rail head with an external shape substantially identical to the rail head of the first or second rail. Notably, because the middle part 122 and the bottom part 121 are configured for having a width W equal to the width of the first or second rail head, an extraction of flanges of a guidance unit is prevented.

As shown in the preferred embodiments presented in FIG. 12, the first projecting member 312A and the rear splice first variable portion, whose length varies in function of the overlapping by said first projecting member 312A, comprise each, and for each roller of a guidance unit designed for guiding a guided vehicle according to a trajectory defined by said first and second rail, a part, preferentially half, of a running surface extending longitudinally and intended to support the considered roller. This feature ensures that what-ever the width D of the expansion gap G is, a roller or wheel will always contact for instance at least half of the running surface it would contact when running on the first or second rail. In order to illustrate this feature, FIG. 12 shows running surfaces RS for each roller of a guidance unit comprising a pair of guiding rollers arranged in a V as shown in FIG. 1 for five different transverse cross-sections C1-C5 taken at five different longitudinal positions of the rail expansion device and identified by their corresponding transverse cross-sections C1-C5 in FIG. 11.

According to the preferred embodiment of the rail expansion device 30 shown in FIG. 11, pair of identical running surfaces RS are arranged symmetrically on each side of a median plane M (i.e. a vertical plane extending longitudinally from the first rail to the second rail and passing through the middle of the rail expansion device) as illustrated in the transverse cross-section C3 of FIG. 12. Said running surfaces of the rail expansion device are configured for continuously extending the running surfaces of the first and second rail so that a guiding roller moving on one side of said median plane M from the first rail to the second rail by passing the rail expansion device according to the invention is continuously in contact with a running surface, i.e. with the rail head, defined by the rail expansion device on said side, in-dependently of a width value D of the expansion gap, with D comprised between the minimal value D' and maximal value D". Each running surface RS of the rail expansion device is intended to support a guiding roller of a guidance unit as illustrated in FIG. 1. For that purpose, said running surfaces RS are in particular not parallel to the ground or track as illustrated in FIGS. 3 and 4, but are tilted with respect to the latter of a tilt angle equal to half of the angle 11 formed by the rotation axes of the guiding rollers 1, 2 (see FIG. 1).

When moving from the first rail to the second rail, a guiding roller will first encounter the running surface of the head of the front connecting rail at its front end FE1, wherein, due notably to identical external shape of their transverse cross-sections, the running surface of the first rail and of the head of the front connecting rail have identical widths and are continuous with each other. The running surface of the head of the front connecting rail extends then continuously from the front end FE1 until the rear end RE1 wherein said head is defined by the shape of the front splice 310. Said shape is configured for providing a continuity of the running surface (i.e. the roller is always in contact with the rail head) along the whole longitudinal length of the front splice 310 until reaching the rear splice 320 that defines the shape of the rail head of the rear connecting rail 32 at the front end FE2. Said shape of the rail head defined by the rear splice 320 is configured for ensuring the continuity of said running surface from the front splice 310 at said front end FE2 until the rear end RE2, wherein the running surface of the second rail head and of the rear connecting rail head at said rear end RE2 have identical widths and are continuous with each other. For instance, the rear connecting rail is characterized, at its rear end RE2, by a rail head whose transverse cross-section external shape is preferentially identical to the external shape of a second rail transverse cross-section, ensuring therefore the continuity of the running surface from the rear end RE2 until the second rail. By continuity of the running surfaces, the present invention means that adjacent/contiguous running surfaces are located in a same plane and have a common line or edge so that a roller moving on said running surfaces will encounter no gap when passing from one running surface to another adjacent/contiguous running surface or when running at the same time on two adjacent/contiguous running surfaces.

The above-mentioned characteristics of the rail expansion device ensure therefore the continuity of a guiding roller running surface from the first rail to the second rail. Preferentially, the width of said running surface RS measured in a transverse cross-section of the rail head is never smaller than half of the width of the nominal running surface of the first or second rail measured in such a transverse cross-section. Indeed, when a guiding roller reaches the front splice 310, it will rest on a running surface whose width is defined by the transverse cross-section C1 (see FIG. 4): the running surface width RSW of each of the running surfaces RS and the width of each of the nominal running surfaces that would be measured on a transverse cross-section of the first or second rail are all equal when considering the transverse cross-section C1. In other words, the base part 312B of the top part 312 comprises running surfaces RS each characterized by a width RSW that is equal to the width of the running surface of the first or second rail that a roller would contact when moving on said first or second rail. When the guiding roller further moves in direction of the second rail, it will either run on a running surface located above the opening 310A (it corresponds notably to the case wherein the width D of the expansion gap G has a value greater than D') and whose width is defined by the transverse cross-section C2 or run on a running surface whose width is defined by the transverse cross-section C3 (it corresponds notably to the case wherein the expansion gap G has a width D=D', i.e. its minimal value, e.g. D'=0). The transverse cross-section C2 passes through the opening 310A, i.e. when the width D of the expansion gap G is greater than D', the top part 312 bridging the opening 310A, having its base part 312B resting and fixed to the bottom part 311 and its first projecting member 312A resting and/or sliding on the rear splice 320. In such a case, the transverse cross-section C2 comprises the transverse cross-section of the bottom part 311 and the transverse cross-section of the first projecting member 312A, with the opening 310A arranged between them and configured for receiving the third projecting member 320A during a decrease of the expansion gap G. As illustrated in FIG. 12, the transverse cross-section of the first projecting member 312A comprises as previously described a pair of running surfaces RS, wherein the width RSW of each of said running surfaces RS is preferentially half of the width of the nominal running surface that a roller would contact when running on the first or second rail. Indeed, and as shown in the transverse cross-sections C3 and C4, the first projecting member 312A comprises half of the width of the nominal running surface and the overlapped part of the rear splice 320, i.e. said first variable portion, comprises preferentially the other half of the width of the nominal running surface as defined by the first or second rail. Therefore, as soon as an opening 310A is created, e.g. due to an increase of the width D of the expansion gap G, the first projecting member 312A will bridge the created opening 310A, the rail expansion device being thus characterized by a rail head transverse cross-section C2 which characterizes the rail expansion device from the base part 312B until a point of the first projecting member 312A where the latter enters into contact with the rear splice 320, wherein the transverse cross-section at said contact point defines a running surface RS as illustrated in the transverse cross-section C3 or C4, i.e. whose width is the sum of the running surface width defined by the first projecting member 312A and the running surface width defined by the part of the rear splice configured for being overlapped by said first projecting member 312A, said sum giving rise therefore to a total running surface width equaling the nominal running surface width. Indeed, the rear splice 320 defines preferentially two identical running surfaces RS arranged as previously explained symmetrically on each sides of the median plane M and characterized by a width measured in a transverse cross-section that is half of the width of the nominal running surface, as shown in transverse cross-sections C3-05. When overlapped by the first projecting member 312A, as illustrated by the transverse cross-sections C3 and C4, the width of the running surface RS of the rear splice 320 is increased by the width of the running surface of the first projecting member 312A so that the resulting width equals said nominal width for all the length of the rear splice that is overlapped by the first projecting member 312A. Any remaining longitudinal length of the rear splice 320 that is not overlapped by the first projecting member 312A will then be characterized by a running surface width RSW equal to half of the nominal running surface width, as shown in the transverse cross-section C5.

To summarize, the front splice 310, as well as the rear splice 320, comprises over its whole length running surfaces RS, wherein the width of each of said running surfaces RS measured in a transverse cross-section is preferentially at least equal to half of the width of the running surface that would contact a roller moving on the first or second rail.

Additionally, as shown in FIG. 12 and previously explained, the width W of the rail head defined by the rail expansion device according to the invention remains constant from the first end FE1 until the rear end RE2, and is preferentially equal to the rail head width of the first or second rail. The widths of the rail head are measured perpendicularly to the median plane M, i.e. within transverse cross-sections as illustrated in FIG. 12. In particular, the rear splice 320 is characterized by a constant maximal width equal to said first or second rail head width. Preferably, the base part 312B of the top part 312 is characterized by a maximal width configured for defining a rail head whose width W is equal to said first or second rail head width. In particular, the first projecting member 312A is characterized by a maximal width W' that is smaller than the first or second rail head width, as shown in the transverse cross-section C2 of FIG. 12. However, since the first projecting member 312A is always located above at least another part of the rail expansion device that is characterized by a width equal to the rail head width of the first or second rail, said another part being for instance the bottom part 311 and/or the rear splice 320, it ensures that said first projecting part 312A together with said another part define a rail head width equal to the width of the first or second rail head. Notably, the longitudinal portion of the bottom part 311 that is configured for being overlapped by the third projecting member 320A is notably characterized by a constant width that is equal to the first or second rail head width.

According to the preferred embodiment illustrated by FIG. 11, only the bottom part 311 and the top part 312 are configured for bridging the expansion gap G, notably when it is characterized by its maximal width value D", having one side supported by the front connecting rail and the other side supported by the rear connecting rail, while the rear splice 320 does not extend beyond the end of the front end FE2. The bottom part 311 is fixed to the body/structure of the first connecting rail 31 and comprises a projecting extremity, i.e. said second projecting member 311A, configured for bridging said expansion gap G when the first rail and second rail move away from one another, said second projecting member 311A being mounted sliding on the body/structure of the second connecting rail within said second opening 321A, taken therefore in sandwich between the body/structure of the second connecting rail and the third projecting member 320A. Preferentially, when the expansion gap G is at its minimal value characterized by the width D', said second projecting member 311A of the bottom part 311 contacts the base part 320B of the rear splice 320. Depending on the length of the third projecting member 320A and whether it bridges or not the expansion gap G, the first opening 310A might be located above the expansion gap G (see FIG. 4), or might remain located above the rear end RE1 (see FIG. 3), or might also be located above the front end FE2 (not shown). In each case, the third projecting member 320A is preferentially sandwiched between the bottom part 311 and the top part 312 mounted sliding within the first opening 310A. When the expansion gap G is at its minimal value characterized by the width D', with preferentially D'=0, said first opening 310A and said second opening 321A are preferentially closed.

As shown in FIGS. 11 and 12, the top part 312 of the front splice comprises a reinforcement structure 313 configured for reinforcing the rigidity of the first projecting member 312A. Preferentially, said reinforcement structure 313 extends longitudinally over the whole length of the first projecting member 312A, and optionally further in direction and over the base part 312B. Said reinforcement structure 313 might be fixed to the top part 312 by any fixing means, or might be obtained by machining, i.e. the top part 312 and its reinforcement structure 313 being one and a same component. The reinforcement structure 313 extends vertically on top of the first projecting member 312A, or optionally on top of the front splice 310, according to a height H that is positive and preferentially comprised between 5-20 mm, with 15 mm being a preferred value, the top surface of said reinforcement structure defining an upper level located at an extra height with respect to the nominal level of the top surface of the first or second rail head.

Consequently, the total height of the rail measured vertically from the base of the rail to the top of its rail head is not the same when measured in a transverse cross-section of the first or second rail, or in a transverse cross-section as shown in FIG. 12. In order to compensate for this height difference, i.e. for the additional height H resulting from the reinforcement structure 313, the rail expansion device 30 according to the invention further comprises a front ramp 314 and a rear ramp 315 configured for guiding a contact shoe of a guidance unit from the nominal level of the top surface of the rail head of the first or second rail to said upper level of the reinforcement structure, located at said extra height with respect to the nominal level.

Figure 13:
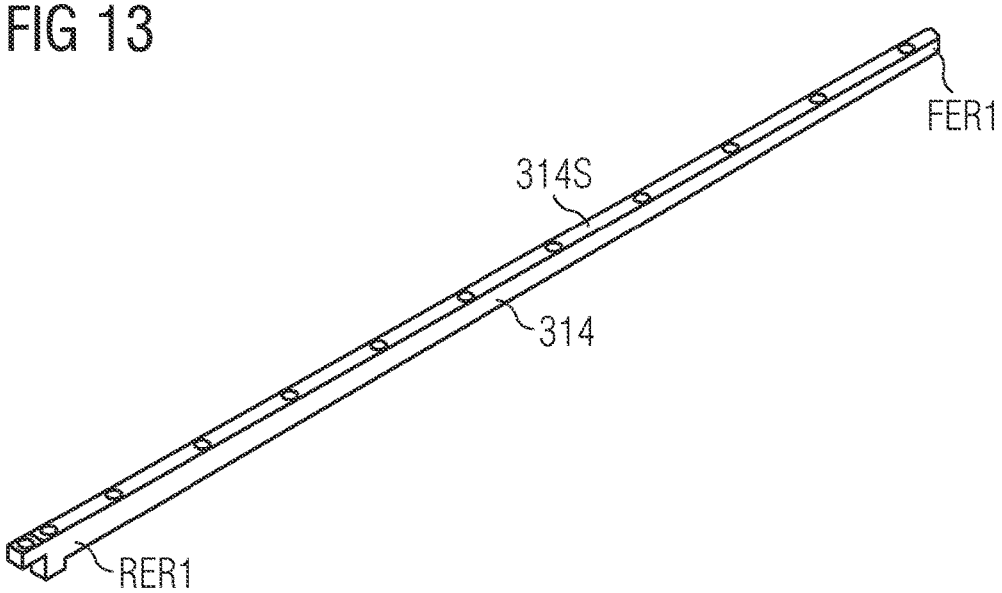
FIG. 13 preferred embodiment for a front ramp according to the invention.

A preferred embodiment of said front ramp, and respectively of said rear ramp, is shown in FIG. 13, respectively 14. The front ramp 314 has a substantial shape of a rod configured for extending from the front splice towards the front end FE1 of the front connecting rail 31. Said front ramp 314 is preferentially fixed to the front connecting rail 31 and to the front splice 310 by any known fixing means, like screws. The front ramp 314 comprises a top surface 314S intended to support a sliding shoe of a guidance unit, said top surface 314S extending from a front extremity FER1 configured for being fixed to the front connecting rail to a rear extremity RER1 configured for being fixed to the front splice 310. Preferentially, the front connecting rail 31 comprises a longitudinal slot or groove 31S (see FIGS. 6 and 9), extending longitudinally at the top of its rail head and configured for receiving said front ramp 314, wherein the depth of said slot or groove 31S decreases when going closer to the front splice 310 so that the top surface 314S of the front extremity FER1 of the front ramp 314 be at the nominal level of the top surface of the rail head of the first or second rail and the top surface 314S of the rear extremity RER1 be at the upper level of the reinforcement structure 313. The top surface 314S defines thus an inclined plane from the nominal level of the rail head to the upper level of the top surface of the reinforcement structure 313.

Figure 14:
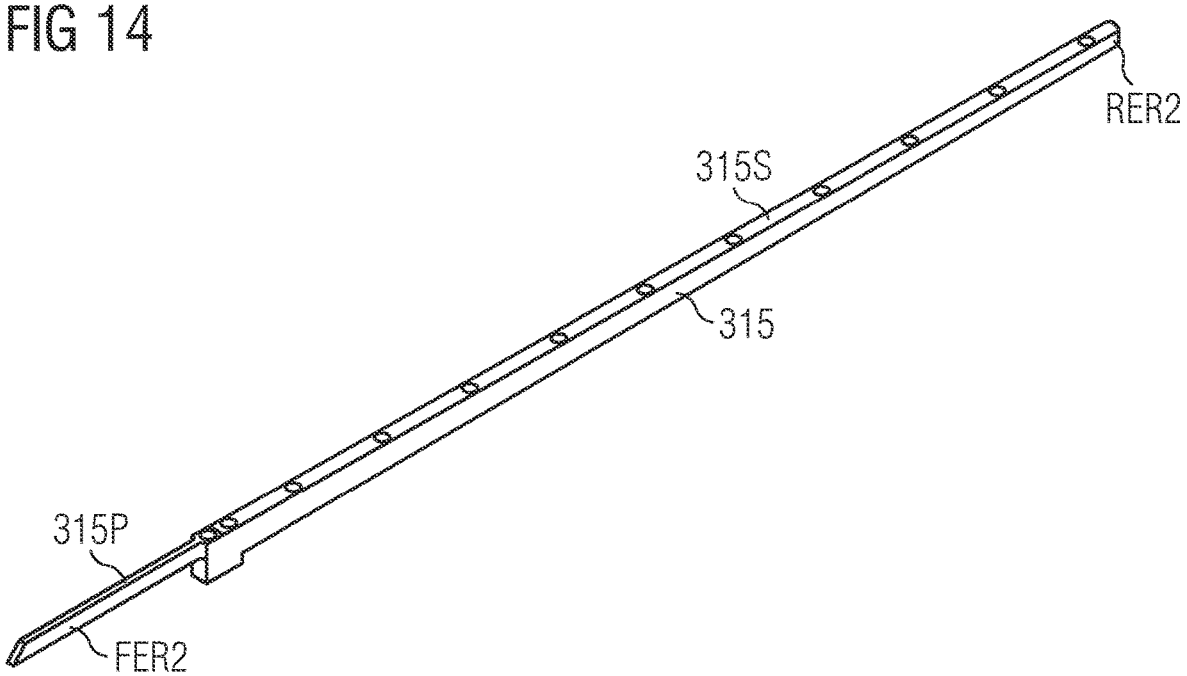
FIG. 14 preferred embodiment for a rear ramp according to the invention.

The rear ramp 315 has a substantial shape of a rod configured for extending from the rear splice 320 towards the rear end RE2 of the rear connecting rail 32. Said rear ramp 315 is preferentially fixed to the rear connecting rail 31 by any known fixing means, like screws. Said rear ramp 315 is free of any fixation to the rear splice 320. Preferentially, it comprises a projecting part 315P (see FIG. 11 and FIG. 14) configured for extending towards the first projecting member 312A and for sliding within a slot or groove 313S arranged in the reinforcement structure 313 located above the first projecting member 312 (see FIG. 12, cross-section T, or FIG. 11). This projecting part 315P enables to slidably connect the rear ramp 315 to the front splice 310 in order to compensate variations of the width D of the expansion gap G. The rear ramp 315 comprises a top surface 315S intended to support the sliding shoe of the guidance unit, said top surface 315S extending from a rear extremity RER2 configured for being fixed to the rear connecting rail to a front extremity FER2 comprising said projecting part 315P and configured for contacting the front splice 310. Preferentially, the rear connecting rail 32 comprises a longitudinal slot or groove 32S (see FIG. 10), extending longitudinally at the top of its rail head and configured for receiving said rear ramp 315, wherein the depth of said slot or groove 32S decreases when going closer to the rear splice 320 so that the top surface 315S of the rear extremity RER2 of the rear ramp 315 be at the nominal level of the top surface of the rail head of the first or second rail and the top surface 315S of the front extremity FER2 be at the upper level of the reinforcement structure 313. The top surface 315S defines thus an inclined plane from the nominal level of the rail head to the upper level of the top surface of the reinforcement structure 313.

Finally, FIG. 15 shows a top view of the rail expansion device according to the invention, wherein the front ramp 314 provides a continuous increase of the height of the rail head for a sliding shoe moving from the first rail towards the second rail so that it can slide over the rail expansion device, and the rear ramp 315 provides for said roller a continuous decrease of said height of the rail head so that it can slides from the top surface of the reinforcement structure back to the nominal level of the top surface of the second rail head.

In conclusion, the present invention proposes to join a first rail to a second rail by means of a splice joint, the latter comprising a front and rear splice, which are removable components of the front and respectively rear connecting rail used for connecting said first rail to second rail, wherein the front splice 310 comprises a top part 312 extending according to its length longitudinally towards the rear connecting rail, said top part 312 comprising a first projecting member 312A configured for overlapping the rear splice 320 over a variable length, wherein the first projecting member 312A and a top portion of the rear splice configured for being overlapped by the first projecting member 312A, define together a rail head and comprise each a part, e.g. half, of the nominal running surface defined by the first or second rail for each roller of a guidance unit configured for running on said first or second rail.

The invention claimed is:

1. A rail expansion device configured for joining a first rail to a second rail, the rail expansion device comprising:

a front connecting rail having a front end and a rear end, wherein said front end is configured for being connected to the first rail;

a rear connecting rail having a front end and a rear end, wherein said rear end of said rear connecting rail is configured for being connected to the second rail;

a splice joint configured for slidably connecting said rear end of said front connecting rail to said front end of said rear connecting rail, said splice joint defining a continuous running surface from said front connecting rail to said rear connecting rail, wherein said continuous running surface has a variable longitudinal length configured for varying in dependence on a width of an expansion gap separating said front connecting rail from said rear connecting rail; and the rail expansion device having a rail head width being constant from said front end of said front connecting rail until said rear end of said rear connecting rail.

2. The rail expansion device according to claim 1, wherein:

said rear connecting rail has a first variable portion; and said splice joint has at least a first projecting member extending from said front connecting rail towards said rear connecting rail and configured for slidably overlapping said first variable portion of said rear connecting rail, wherein said first projecting member and said first variable portion comprise each a part of said continuous running surface.

3. The rail expansion device according to claim 2, wherein:

said rear connecting rail has a second variable portion; and said splice joint having a second projecting member extending from said front connecting rail towards said rear connecting rail and configured for slidably overlapping said second variable portion of said rear connecting rail.

4. The rail expansion device according to claim 3, wherein:

said rear connecting rail having a third projecting member; and said first projecting member is mounted over said second projecting member so as to define a first opening configured for receiving said third projecting member extending from said rear connecting rail towards said front connecting rail, and wherein a second opening is defined between said rear connecting rail and said third projecting member and configured for receiving said second projecting member.

5. The rail expansion device according to claim 4, wherein said splice joint has a front splice configured to be fixed to said front connecting rail and a rear splice configured to be fixed to said rear connecting rail, wherein said front splice contains said first projecting member that is configured for bridging the expansion gap, wherein said rear splice has said first variable portion, wherein said first projecting member is configured for slidably resting on said first variable portion of said rear splice.

6. The rail expansion device according to claim 5, wherein said front splice has a top part extending according to its length longitudinally towards said rear connecting rail, said top part has a base part and said first projecting member, wherein said base part is configured for being fixed to said front connecting rail and wherein said first projecting member extends from said base part towards said rear connecting rail for bridging the expansion gap.

7. The rail expansion device according to claim 5, wherein said rear splice has said third projecting member, said third projecting member having said first variable portion.

8. The rail expansion device according to claim 6, wherein said front splice has a bottom part configured for being fixed to said front connecting rail and for supporting said base part of said top part, wherein said bottom part has said second projecting member.

9. The rail expansion device according to claim 8, wherein said bottom part has at least a portion with a constant width, said portion extending longitudinally at least from a first transverse cross-section to a second transverse cross-section, wherein said first transverse cross-section is configured for being located at a first longitudinal extremity of said first opening and said second transverse cross-section at a second longitudinal extremity of said first opening defined when said first opening is at its maximum, wherein said first longitudinal extremity is the longitudinal extremity directed towards said front connecting rail and said second longitudinal extremity is the longitudinal extremity directed towards said rear connecting rail, wherein said constant width is configured for being equal to a width of a head of the first rail or of the second rail.

10. The rail expansion device according to claim 1, wherein:

said front connecting rail has a first rail head;

said rear connecting rail has a second rail head; and said first projecting member has a width that is smaller than a nominal width of said first or second rail head.

11. The rail expansion device according to claim 1, wherein said continuous running surface defined by said first projecting member and said continuous running surface defined by said first variable portion have an identical width.

12. The rail expansion device according to claim 1, wherein said front connecting rail has a base;

wherein said rear connecting rail has a base; and further comprising a connection box configured for clamping said base of said front connecting rail and said base of said rear connecting rail, so that a transverse and/or vertical relative motion is prevented while a relative longitudinal displacement is authorized and limited.

13. The rail expansion device according to claim 12, further comprising a clamping system, said connection box is mounted mobile in translation in said clamping system, wherein said clamping system is configured for being fixed to ground and for authorizing a longitudinal translation of said connection box with respect to the ground, while preventing any vertical and transverse motion of said connection box.

14. The rail expansion device according to claim 1, further comprising a longitudinally extending reinforcement structure, said first projecting member is surmounted by said longitudinally extending reinforcement structure.

15. A method for compensating an expansion of an end of a first rail relatively to an end of a second rail, which comprises the step of:

connecting the end of the first rail to the end of the second rail by means of the rail expansion device according to claim 1.

* * * * *